US005289765A

United States Patent [19]

Gray

[11] Patent Number: 5,289,765

[45] Date of Patent: Mar. 1, 1994

[54] DEVICE WITH FLEXIBLE ELONGATE MEMBER FOR BINDING AND TOTING TREE TRIMMINGS AND THE LIKE

[76] Inventor: Ronald D. Gray, 3249-37th Ave., Rock Island, Ill. 61201

[21] Appl. No.: 988,199

[22] Filed: Dec. 9, 1992

[51] Int. Cl.[5] ..... B65B 13/18; B65B 27/10

[52] U.S. Cl. ..... 100/34; 100/212

[58] Field of Search ..... 100/34, 212; 24/19, 24/71.1, 269

[56] References Cited

U.S. PATENT DOCUMENTS

| | | | |
|---|---|---|---|
| 338,092 | 3/1886 | Mahin | 100/212 |
| 398,935 | 3/1889 | Beu | 100/212 X |
| 411,721 | 9/1889 | Harter | 24/269 |
| 549,066 | 10/1895 | Houck | 100/34 |
| 752,870 | 2/1904 | Smith | 100/212 |
| 759,219 | 5/1904 | McCaulley et al. | 100/212 |
| 1,115,085 | 10/1914 | Miller | 100/212 |
| 1,188,897 | 6/1916 | Case | 100/212 |
| 1,405,052 | 1/1922 | Maher . | |
| 1,774,891 | 9/1930 | Kidwell | 100/212 X |
| 2,912,151 | 11/1959 | Crabs . | |
| 3,990,146 | 11/1976 | Asselta . | |
| 4,460,028 | 7/1984 | Henry . | |

FOREIGN PATENT DOCUMENTS

| | | | |
|---|---|---|---|
| 72203 | 6/1866 | France | 100/212 |

*Primary Examiner*—Stephen F. Gerrity

*Attorney, Agent, or Firm*—Simmons, Perrine, Albright & Ellwood

[57] ABSTRACT

An improved device and method are provided for bundling debris, such as tree, shrubbery and rosebush trimmings and the like. The device has an elongate body member with a grip, a guide with an opening, and a retainer. An elongate flexible member, which has a connector at one end detachably connected to the retainer and a handle at the other end, is adapted to be slidably displaced through the opening to compress the debris from an uncompacted configuration to a compacted configuration. An adapter is provided to releasably maintain the debris, in conjunction with the flexible member, in the compacted configuration as a binder is tied around the debris to form a transportable bundle of the debris in the compacted configuration. The device may optionally be integrally constructed, including a binder holder with or without a top for foot bearing purposes and/or a cutter for the binder, if desired. The device also includes a hook, or the like, to engage the binder about the bundle for manually transporting the bundle for disposal thereof. A method of using the device is described for bundling the debris.

2 Claims, 2 Drawing Sheets

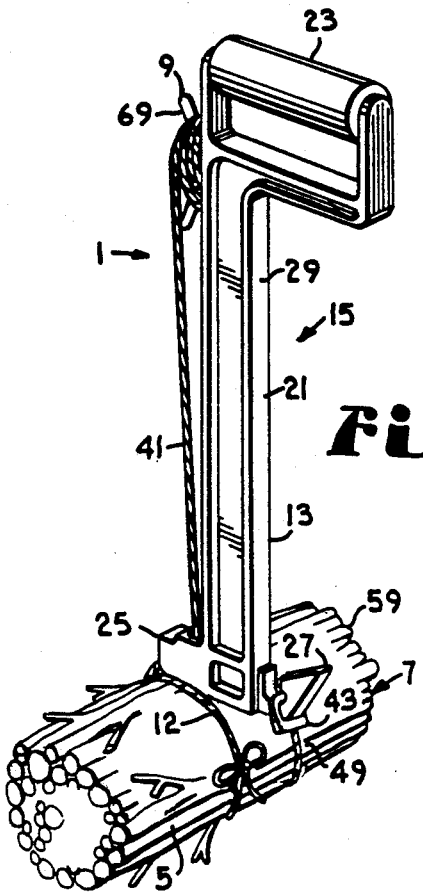
Fig. 7.
Fig. 4.
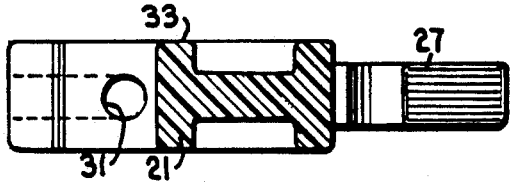
Fig. 9.
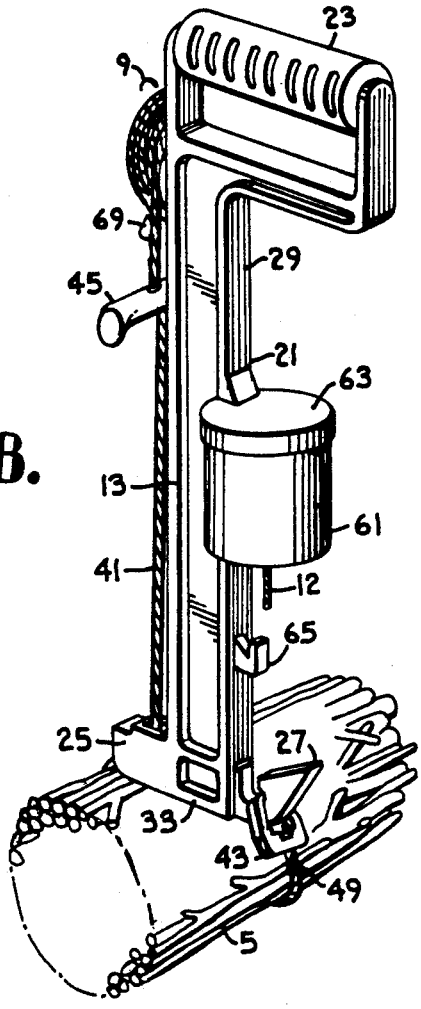
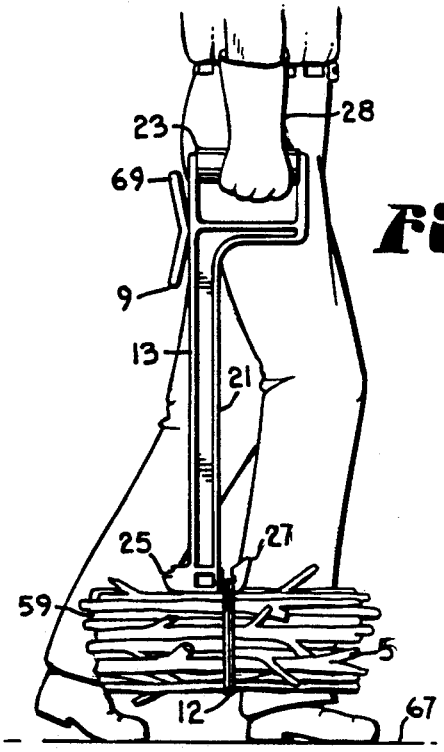
Fig. 8.

DEVICE WITH FLEXIBLE ELONGATE MEMBER FOR BINDING AND TOTING TREE TRIMMINGS AND THE LIKE

BACKGROUND OF THE INVENTION

1. Field of the Invention.

The present invention relates generally to disposing of waste materials, and, in particular, to disposing of tree, shrubbery and rosebush trimmings and the like.

2. Description of the Related Art.

Landfills have been used to dispose of a multitude of different types of waste. Such waste has originated from many different sources. Due to the expansiveness of the population and the general wastefulness of our society, the quantity of that waste has placed tremendous burdens on the available landfills, and the methods of picking up that waste and delivering it to those landfills has pushed present capabilities to process that waste almost to beyond capacity.

In response to these burdensome demands required by our society, many cities now require yard waste such as grass cuttings and tree, shrubbery and rosebush trimmings to be bundled separately from other garbage. For example, many cities have mandated that such trimmings must be properly bundled or the waste collectors will not remove the trimmings from the property but will be left curbside until they are property bundled. In addition, many of those municipalities not only specify that the trimmings be bundled, but that the bundles not exceed a certain length, a certain weight, or both. The mandated sizes of the bundles generally range between 3'-6', with most cities specifying a maximum length of 4'. The mandated weights of the bundles generally range between 25-80 pounds, with many of the cities specifying a maximum weight of 50 pounds.

One problem commonly incurred during the handling and disposing of branches and trimmings is the uncooperative nature thereof. As one tries to bundle such items, the stiffness and bulkiness resists reasonable efforts to manually compress the limbs into a compact bundle which is easier to handle because it is not so bulky. Various rudimentary techniques have been attempted, largely without success, but accepted out of frustration. Many times that frustration was further aggravated due to slippage of the cord binding the bundle, thereby losing whatever advantage had been initially gained.

As a result, the limbs generally were not compressed into conveniently sized bundles and more trips were required to carry the bundles to curbside for further disposition. In addition, the bundles sometimes contain trimmings from rosebushes, locust trees, and other thorny flora which is capable of inflicting injury, sometimes severe, not only to the flesh of those carrying the bundles but also to ones clothes.

What is needed is a device and a method whereby trimmings from trees, shrubbery, rosebushes, and the like can be quickly, easily, conveniently and reliably compressed into compact bundles and manually carried to curbside or other desired location with minimal effort and risk to flesh or clothing.

SUMMARY OF THE INVENTION

An improved device and method are provided for bundling debris, such as tree, shrubbery and rosebush trimmings and the like. The device has an elongate body member with a grip connected to one end and a guide with an opening and a retainer connected to the other end. An elongate flexible member has a connector at one end detachably connected to the retainer and a handle at the other end. The flexible member is adapted to be displaced slidably through the opening. The flexible member has sufficient length to extend from the connector as connected to the retainer, around the debris, and through the opening such that a user can use the handle to conform the debris from an uncompacted configuration to a compacted configuration.

An adapter is provided, in conjunction with the flexible member, to releasably maintain the debris in the compacted configuration as a binder is tied around the debris to form a transportable bundle of the debris in the compacted configuration. The device may optionally be integrally constructed, including a binder holder and/or a cutter for the binder, if desired. The holder may be constructed whereby the user's foot may be used to assist and/or stabilize the device and the debris is compressed from the uncompacted configuration to the compacted configuration.

The device also includes a hook, or the like, to engage the binder about the bundle for manually transporting the bundle for disposal thereof.

A method of using the device is described for bundling tree trimmings and the like.

OBJECTS AND ADVANTAGES OF THE INVENTION

The principal objects and advantages of the present invention include: providing a method and device for bundling waste debris, such as small tree branches, tree shrubbery, and rosebush trimmings; providing such a method and device for compressing such debris into compact, easy to handle bundles; providing such a method and device for facilitating municipal bundling requirements; providing such a method and device for minimizing risk of injury to flesh and clothing arising from such debris; providing such a device in the form of a hand-held tool; providing such a method and device which can be easily accomplished and operated by a person working alone; and providing such a device which is economical to manufacture, efficient in operation, capable of long operating life and particularly well-adapted for the proposed usages thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 4 is an enlarged, cross-sectional view of the device, taken generally along line 4—4 of FIG. 1.

FIG. 7 is a reduced, perspective view of the device, similar to that shown in FIG. 5, but showing the debris in a compacted configuration, a binder about a bundle of the debris and a flexible member of the device wound about an adapter thereof.

FIG. 8 is a further reduced, side elevational view of the device, shown with the bundle of the debris being toted therewith.

FIG. 9 is a reduced, perspective view of the device for bundling tree trimmings and the like, similar to that of FIG. 7, but showing an alternative embodiment having a binder holder and a cutter, according to the present invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 5:
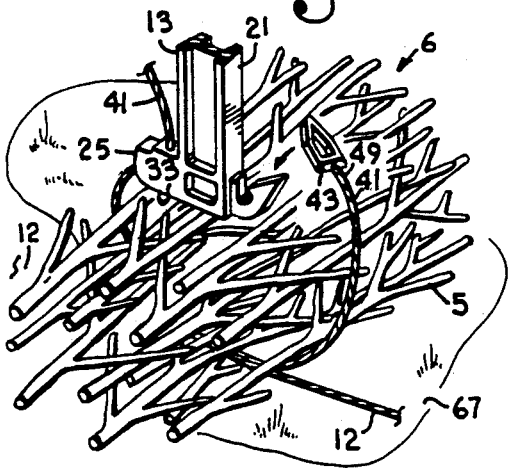
FIG. 5 is a reduced and fragmentary, perspective view of the device, shown with debris in an uncompacted configuration.
Figure 6:
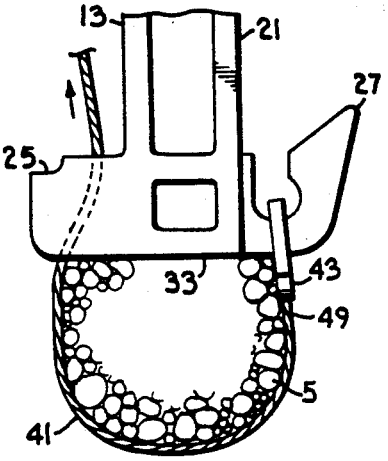
FIG. 6 is a fragmentary side-elevational view, enlarged from that shown in FIG. 5, showing the debris being compressed from the uncompacted configuration to a compacted configuration.

The reference numeral 1 generally refers to a device for bundling tree trimmings and the like in accordance with the present invention, as shown in FIGS. 1 through 9. The device 1 generally includes compacting means 3 for compacting debris 5, such as tree, shrubbery and rosebush trimmings and the like, from an uncompacted configuration 6, as shown in FIG. 5, to a compacted configuration 7, as shown in FIG. 5; securing means 9 for releasably securing the debris 5 in the compacted configuration 7; binding means, such as a binder 12 for binding the debris 5 in the compacted configuration 7; and frame means 13 for combining various components of the device 1, generally including the compacting means 3 and the securing means 9, into a portable hand tool 15.

The frame means 13 generally includes an elongate body member 21, a grip 23, a guide 25 and a retainer 27, such as a hook or other suitable arrangement. The grip 23, which is adapted to comfortably fit a hand of a user 28, is connected to a proximal end 29 of the body member 21. The guide 25, which has an opening 31, and the retainer 27 are connected to the body member 21 near a distal end 33 thereof.

The compacting means 3 generally include an elongate flexible member 41, such as a cord, rope or the like; a connector 43, such as a loop, hook or the like; and a handle 45. The handle 45 is connected to a proximal end 47 of the flexible member 41 and the connector 43 is connected to a distal end 49 of the flexible member 41. The connector 43 is adapted to be detachably connected to the retainer 27 as the debris 5 is being compressed from the uncompacted configuration 6 to the compacted configuration 7.

Figure 1:
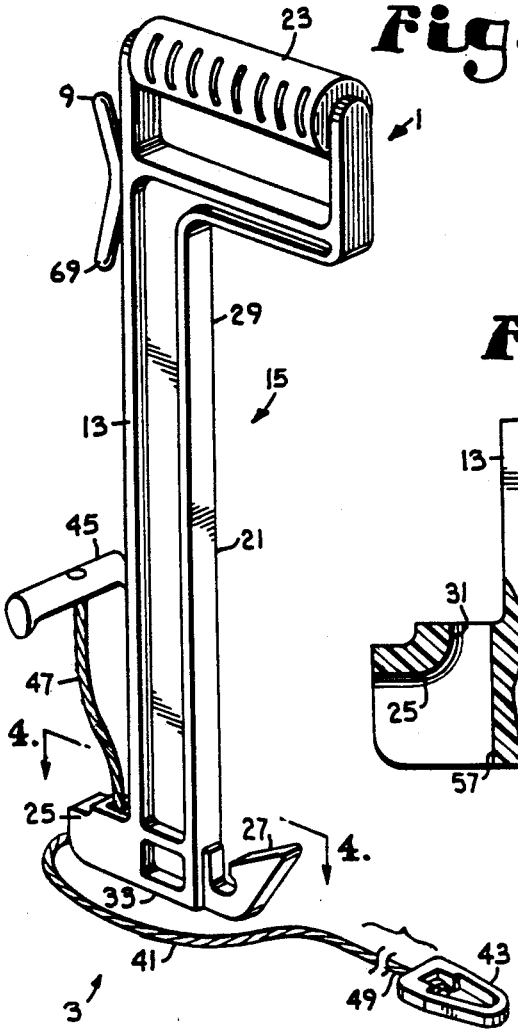
FIG. 1 is a perspective view of a device for bundling tree trimmings and the like, according to the present invention.
Figure 2:
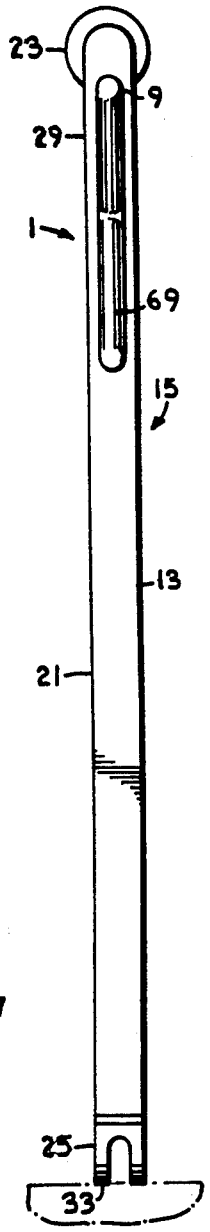
FIG. 2 is a side elevational view of the device.
Figure 3:
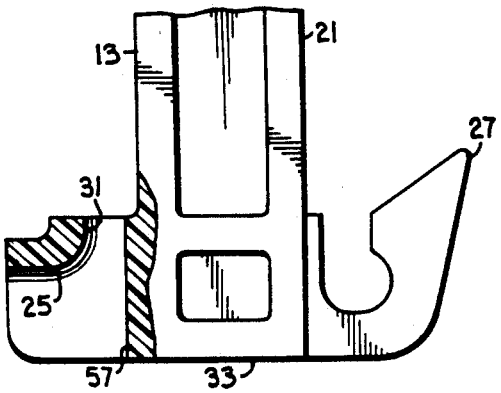
FIG. 3 is an enlarged and fragmentary, side elevational view of the device cut away to reveal detail thereof, showing a retainer and a guide thereof.

The flexible member 41 is adapted to be slidably displaced through the opening 31. The flexible member 41 has sufficient length to extend from the connector 43 connected to the retainer 27, around the debris 5 in the uncompacted configuration 6, and through the opening 31 of the guide 25 such that the handle 45 is easily graspable by the user 28. Preferably, a lower portion 57 of the opening 31 is adapted to receive the flexible member 41 at any angle from vertically to horizontally, as shown in FIG. 3, to facilitate the changing dimensions of the debris 5 as the debris 5 is transformed from the uncompacted configuration 6 to the compacted configuration 7.

The binder 12 generally comprises twine, plastic tape or the like for binding the debris 5 in the compacted configuration 7, as a transportable bundle 59 as shown in FIG. 8, after removal of the flexible member 41 from about the debris 5 as described herein.

Alternatively, the device 1 may include a holder 61 for conveniently storing the binder 12 therein. The holder 61 may be connected to the body member 21, as shown in FIG. 9. If further desired, a top 63 of the holder 61 can be used to apply downward pressure with a foot of the user 28 to thereby assist in, and to possibly provide additional stability while, transforming the debris 5 from the uncompacted configuration 6 to the compacted configuration 7. Also, the user 28 can stand on the debris 5 with his other foot to further assist with compression of the debris 5 from the uncompacted configuration 6 to the compacted configuration 7. The device 1 may also optionally include a cutter 65 for cutting desired lengths of the binder 12.

If desired, the securing means 9, the frame means 13, the grip 23, the guide 25, and the retainer 27, or any combination thereof, may be integrally connected, such as by injection molding or the like. In addition, the holder 61 and/or appropriate portions of the cutter 65 may also be integrally connected therewith.

In an application of the present invention, the flexible member 41 is laid generally linearly along a surface of the ground 67. A length of the binder 12 is laid generally alongside the flexible member 41. Then, a quantity of the debris 5, sufficient to comprise a bundle 59 within the limits mandated by local ordinances or other regulations, is placed across the flexible member 41 and the binder 12 such that the flexible member 41 and the binder 12 are spaced approximately centrally to the extremities of the debris 5 lying thereacross, or approximately near the center of gravity of the debris 5, as appropriate.

If desired, the ends of either the flexible member 41 or the binder 12, or both, extending outwardly from the debris 5 may be grasped and lifted upwardly to determine whether the mass of the debris 5 is approximately balanced relative to the location of the flexible member 41, etc. If not, the flexible member 41 and the binder 12 may be shifted laterally to effect such approximate balance.

With the connector 43 connected to the retainer 27 and the body member 21 arranged in a generally upright orientation, the user 28 grasps the handle 45 and pulls the flexible member 41 lengthwise through the opening 31 of the guide 25, thereby transforming the debris 5 from the uncompacted configuration 6 to the compacted configuration 7. To temporarily maintain the debris 5 in the compacted configuration, the securing means 9, such as an adapter 69, is activated by winding the flexible member 41 around the adapter 69, as shown in FIG. 7.

As the securing means 9, in cooperation with the flexible member 41, maintains the debris 5 in the compacted configuration 7, the ends of the binder 12 are manually drawn around the debris 5 and tied or otherwise connected to form the bundle 59 in order to assure retention of the debris 5 in the compacted configuration 7. Then, the securing means 9 is deactivated, such as by unwinding the flexible member 41 from about the adapter 69, thereby freeing the device 1 from the bundle 59 of the debris 5. In some applications of the device 1, the debris 5 in the compacted configuration 7 occupied a volume of only approximately one-third or less of the volume occupied by the debris 5 in the uncompacted configuration 6.

To transport the bundle 59 for further disposition, such as collection by a disposal service, it is a simple matter to engage toting means, such as the retainer 27 used as a hook, with the binder 12, as shown in FIG. 8. As a result of using the device 1, the debris 5 can be compressed into a smaller quantity of the bundles 59, thereby providing time savings for both the user 28 disposing of the debris 5 and the waste collectors loading their trucks.

It is to be understood that while certain forms of the present invention have been illustrated and described herein, it is not to be limited to the specific forms or arrangement of parts described and shown.

What is claimed and desired to be secured by Letters Patent is as follows:

1. A device for compacting and bundling tree trimmings, comprising:

(a) compacting means for compacting the tree trimmings from an uncompacted configuration to a compacted configuration; said compacting means includes an elongate member, guide means for slidably receiving said elongate member therethrough, a handle and a connector; said handle connected to one end of said elongate member and said connector connected to the other end of said elongate member;

(b) securing means for releasably securing the tree trimmings in said compacted configuration;

(c) binding means for binding said tree trimmings in said compacted configuration; and (d) a frame having a body member adapted to combine said compacting means and said securing means into a portable hand tool; said guide means disposed near a distal end of said body member.

2. A device for compacting and bundling tree trimmings, comprising:

(a) an elongate body member having a proximal end and a distal end;

(b) a grip connected to said proximal end of said body member;

(c) a guide connected to said body member near said distal end thereof; said guide having an opening therethrough;

(d) an elongate flexible member having a proximal end and a distal end; said flexible member adapted to be slidably displaced through said opening as said body member is oriented generally vertically;

(e) a handle connected to said proximal end of said flexible member;

(f) a connector connected to said distal end of said flexible member;

(g) a hook connected to said distal end of said body member; said hook adapted to detachably retain said connector thereon as said flexible member is slidably displaced through said opening;

(h) a securing member connected to said body member; said securing member adapted to releasably secure said flexible member as the debris is in said compacted configuration;

(i) a disposable binding member adapted to maintain the debris in said compacted configuration; said binding member is adapted to cooperate with said hook such that said binding member is removably retained by said hook as said body member is transported in a generally upright orientation;

(j) a holder adapted to contain said binding member; and (k) a cutter adapted to selectively sever said binding member; said cutter connected to said body member.

* * * * *